United States Patent [19]

Minkkinen

[11] 4,097,370

[45] Jun. 27, 1978

[54] HYDROTREATING OF PYROLYSIS GASOLINE

[75] Inventor: Ari A. Minkkinen, Mountain Lakes, N.J.

[73] Assignee: The Lummus Company, Bloomfield, N.J.

[21] Appl. No.: 787,506

[22] Filed: Apr. 14, 1977

[51] Int. Cl.[2] ..... C10G 23/00

[52] U.S. Cl. ..... 208/255; 208/144

[58] Field of Search ..... 208/255, 144

[56] References Cited

U.S. PATENT DOCUMENTS

| | | | |
|---|---|---|---|
| 2,974,099 | 3/1961 | Anderson, Jr. | 208/144 |
| 3,094,481 | 6/1963 | Butler et al. | 208/255 |
| 3,124,526 | 3/1964 | Butler et al. | 208/255 |
| 3,215,618 | 11/1965 | Watkins | 208/255 |
| 3,493,492 | 2/1970 | Sze | 208/255 |

FOREIGN PATENT DOCUMENTS

| | | | |
|---|---|---|---|
| 923,062 | 3/1973 | Canada | 208/255 |

*Primary Examiner*—George Crasanakis
*Attorney, Agent, or Firm*—Marn & Jangarathis

[57] ABSTRACT

In the hydrotreating of pyrolysis gasoline, recycle effluent is treated to separate the more volatile components therefrom, prior to recycle, to thereby increase the hydrogen partial pressure of the hydrotreating. In this manner, total pressures can be reduced to correspond to the pressure of the available hydrogen gas, while retaining the kinetic benefits of increased partial pressures.

7 Claims, 2 Drawing Figures

HYDROTREATING OF PYROLYSIS GASOLINE

Figure 1:
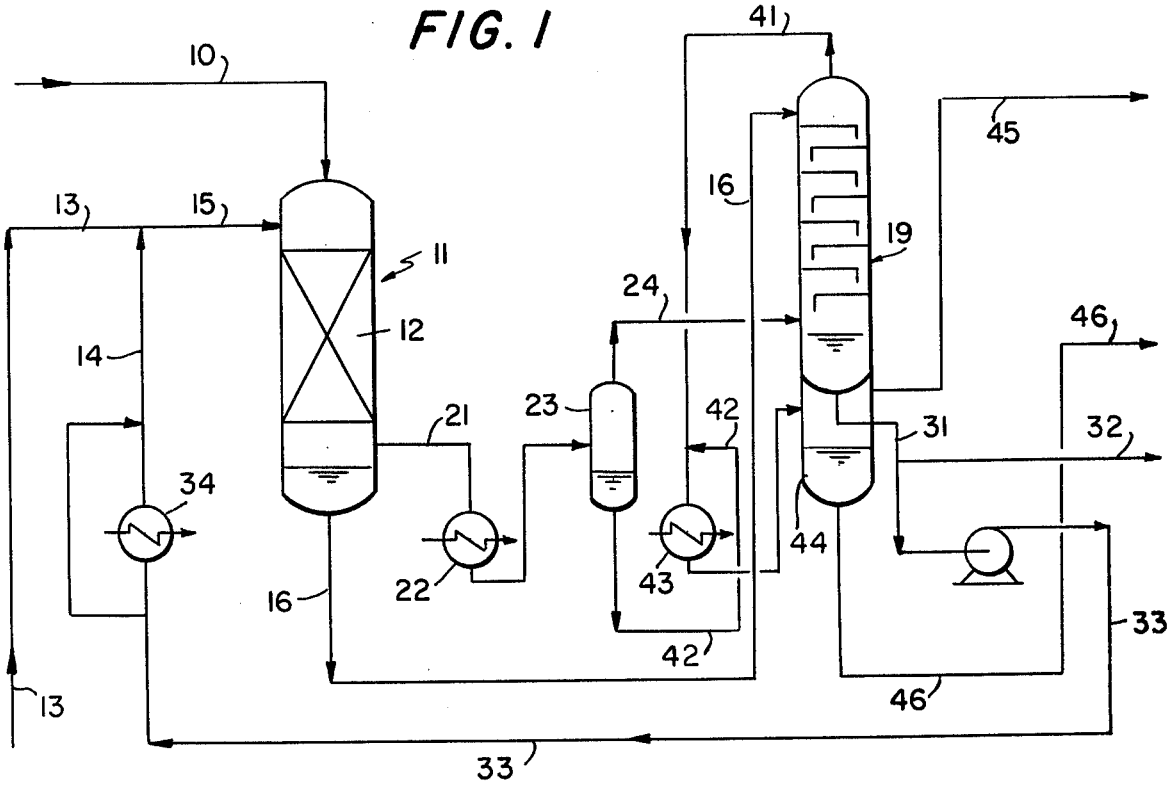

This invention relates to the hydrotreating of pyrolysis gasoline or dripolene.

In hydrotreating of a pyrolysis gasoline or dripolene (the terms are interchangeably employed), the reaction pressure is generally in the order of 600 to 1,000 psig depending on the feedstock. The hydrogen containing gas employed for the hydrotreating is generally obtained from an olefin plant and such gas is generally available at a pressure of in the order of 400 psig, thereby necessitating the use of a booster compressor for feeding such gas to the hydrotreating operation.

It has now been found that the hydrotreating can be effected at lower pressures; e.g., in the order of 200 to 400 psig; however, the use of such lower pressures severely limits the ability to achieve high hydrogen partial pressures, which, based on reaction kinetics, should be maximized.

An object of the present invention is to provide an improved process for the hydrotreating of a pyrolysis gasoline.

Another object of the present invention is to provide for the hydrotreating of a pyrolysis gasoline at increased hydrogen partial pressures.

A further object of the present invention is to provide for effective hydrotreating of pyrolysis gasolines at lower total pressures.

These and other objects of the invention should be more readily apparent from reading the following description thereof.

In accordance with the present invention there is provided a process for hydrotreating a pyrolysis gasoline wherein fresh feed pyrolysis gasoline, hydrogen containing gas and recycle hydrotreated effluent are contacted in a hydrotreating zone to produce a hydrotreated effluent. Lighter components are separated from all or the recycle portion of the hydrotreated effluent to reduce or eliminate the total quantity of lighter components present in the recycle portion of the hydrotreated effluent. Applicant has found that by separating lighter components from the recycle portion of the hydrotreated effluent there is obtained, at a given total reaction pressure, an increased hydrogen partial pressure.

Although Applicant does not intend to limit the invention by any theoretical reasoning, it is contended that by separating or leaning the recycle effluent with respect to lighter components, the leaned recycle effluent functions as an absorbing oil to restrict volatization of light hydrocarbons and to remove dew point hydrocarbons in the hydrogen rich vapor existing in the reactor thereby resulting in higher hydrogen partial pressure. Thus, at a given total reactor pressure, it is possible to maximize the hydrogen partial pressure.

The recycle effluent is leaned of lighter components, i.e., $C_5$ and lighter hydrocarbons. In general, the hydrotreated effluent is treated to reduce the content of $C_5$ and lighter hydrocarbons in an amount whereby at least 5 mol %, preferably at least 10 mol %, and most preferably at least 20 mol % of the $C_5$ and lighter hydrocarbons are removed from the portion of the effluent which is to be recycled to the hydrotreating reactor. As should be apparent, it is possible to effect 100% removal of $C_5$ and lighter hydrocarbons; however, as a practical matter, in general, such 100% removal is not effected, with the $C_5$ and lighter hydrocarbon removal generally being no greater than about 70 mol %. The greater the amount of $C_5$ and lighter hydrocarbon removal, the greater the increase in hydrogen partial pressure in the hydrotreating reactor. It is to be understood that components which boil above $C_5$ may also be removed from the effluent or recycle portion during the separation.

The reduction in $C_5$ and lower boiling hydrocarbons may be effected by any one of a wide variety of procedures. In accordance with a preferred procedure, $C_5$ and lighter hydrocarbons are flashed from the effluent or from the recycle portion. The flashing may be supplemented by stripping of such lighter components; e.g., by the use of a hydrogen containing gas recovered from the hydrotreating reactor. As hereinabove noted, other components may also be separated from the liquid effluent or recycle liquid effluent portion during such flashing or stripping, provided that the operation effects the reduction in the content of $C_5$ and lower boiling components. The selection of a suitable means of effecting such reduction should be apparent to those skilled in the art from the teachings herein.

The hydrotreating of the pyrolysis gasoline is generally effected at conditions known in the art, except that by proceeding in accordance with the present invention, it is possible to operate at lower total pressures, while simultaneously employing suitable hydrogen partial pressures. Although the present invention is particularly suitable for operation at lower pressures (in the order of 200 to 400 psig), it is to be understood that the invention is also applicable to the higher total pressures generally employed in the art.

The hydrotreating of pyrolysis gasoline is generally effected with a hydrogen containing gas (the gas generally contains from 50 to 100%, and most generally from 90 to 95% of hydrogen) at reactor inlet temperatures of from 120° F to 400° F, and at total pressures of from 200 to 800 psig, with the present invention, as hereinabove noted, being preferably effected at total pressures of from 200 to 400 psig. The hydrogen is generally employed in an amount which is in excess of the stoichiometric requirements, with such excesses generally being in the order of from 10 to 50% over that required to saturate one double bond of the conjugated di-olefins and styrenes in the feed. In general, the temperature rise through the reactor is in the order of from 50° F to 100° F.

In accordance with the present invention, it is possible to achieve log mean hydrogen partial pressures in the order of from 135 to 510 psig at total pressures in the order of from 200 to 800 psig, with the log mean hydrogen partial pressures being in the order of from 135 to 260 psig at total pressures in the order of from 200 to 400 psig.

The recycle hydrotreated effluent is generally employed in an amount to provide recycle to fresh feed ratios of from 1:1 to 10:1 basis. Recycle of effluent is practiced to control the exothermic temperature rise across the reactor bed. Furthermore, by varying the heat removal from the recycle stream the reaction temperature level can be adjusted.

In accordance with the present invention, the recycle when leaned (i.e., denuded of volatile components) will absorb dew point hydrocarbons from the hydrogen rich vapor phase and maintain the remaining volatile components in the liquid phase, thereby increasing the hydrogen partial pressure in the hydrotreating reactor.

The hydrotreating is effected in the presence of a suitable hydrotreating catalyst. The hydrotreating catalyst can be a noble metal catalyst; e.g., palladium with or without modifiers supported on alumina or a nonnoble metal catalyst, such as nickel alone, or in conmbination with tungsten or molybdenum or a cobalt-molybdenum catalyst. The catalysts which are suitable for the hydrotreating of pyrolysis gasolines are known in the art and the selection of a suitable catalyst is deemed to be well within the scope of those skilled in the art.

Figure 2:
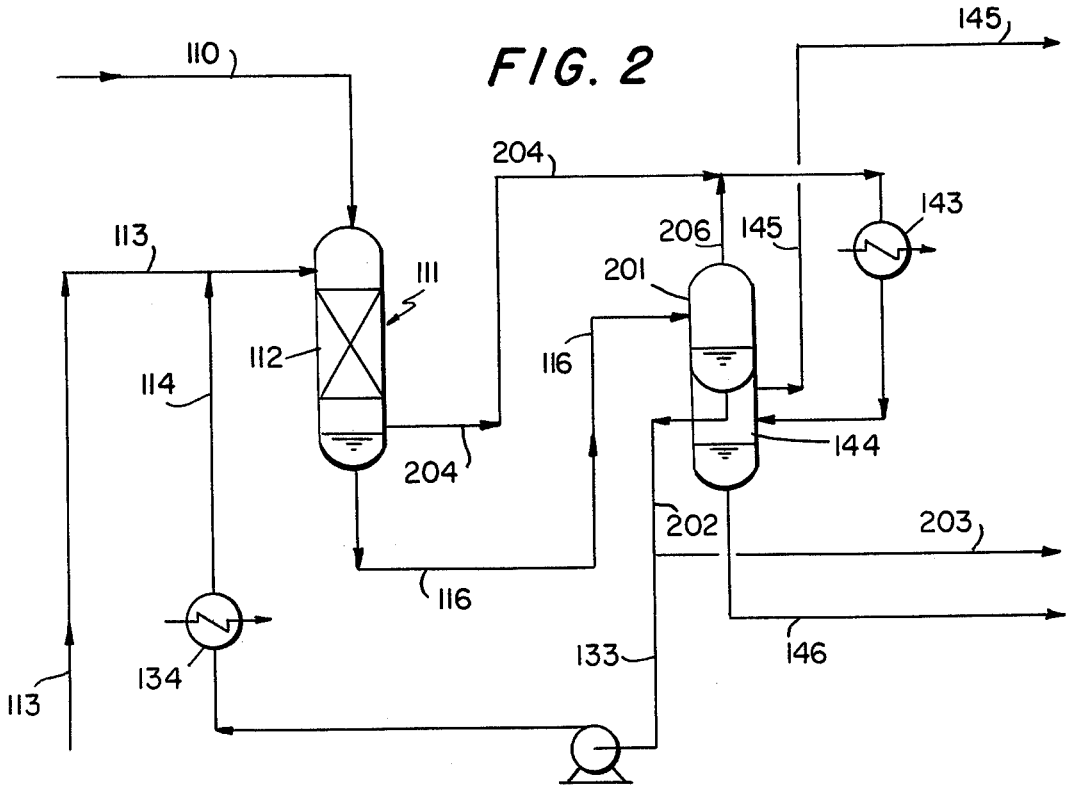

The invention will be further described with respect to the accompanying drawings wherein:

FIG. 1 is a simplified schematic flow diagram of an embodiment of the present invention and FIG. 2 is a simplified schematic flow diagram of a modification of the embodiment of FIG. 1.

Referring now to FIG. 1, pyrolysis gasoline, in line 13 is admixed with recycle leaned hydrotreated effluent, in line 14, obtained as hereinafter described, and the combined stream is introduced through line 15 into a hydrotreating reactor 11, containing a bed of a suitable hydrotreating catalyst, schematically designated as 12. A hydrogen containing gas, for example, a gas recovered from an olefin plant which contains, for example, 90 to 95 mol % hydrogen and remainder methane, in line 10 is also introduced into reactor 11. In accordance with the preferred embodiment, the total pressure in reactor 11 is at a value which corresponds to the hydrogen gas supply pressure; for example, 400 psig, thereby eliminating the necessity for the use of a booster compressor for the hydrogen gas feed. In reactor 11, as known in the art, the pyrolysis gasoline is hydrogenated to selectively hydrotreat the dienes and styrenes present in the pyrolysis gasoline.

A liquid hydrotreated effluent is withdrawn from reactor 11 through line 16 and introduced into a stripping column 19 to separate the more volatile components from the liquid effluent. The stripper 19 is operated at a pressure lower than that prevailing in reactor 11 in order to effect a substantial flashing of the more volatile components dissolved in the liquid effluent.

A gaseous effluent, containing the excess hydrogen, is withdrawn from reactor 11 through line 21 and passed through condenser 22 to condense entrained hydrocarbons which are separated in separator 23.

Hydrogen gas, lean of hydrocarbons, is withdrawn from separator 23 through line 24 and introduced into stripper 19 as a stripping gas.

The stripper 19 is operated at temperatures and pressures to effect the desired separation of volatile hydrocarbon components by both flashing, and stripping with hydrogen gas recovered from the hydrotreating reactor. The greater the amount of volatile components separated from the effluent the higher the hydrogen partial pressure which can be achieved in reactor 11. As should be apparent, at the maximum, the total amount of components which can be stripped from the effluent corresponds to the net effluent. Increased removal of volatile components can be effected by a further decrease in the pressure and/or an increase in the amount of hydrogen stripping gas. In general, the stripping is effected by the use of hydrogen stripping gas as well as a pressure reduction to a pressure of from 50 to 200 psi less than the pressure in reactor 11. The stripping is generally effected at a temperature which corresponds to the reactor outlet temperature, i.e., no additional heating or cooling of effluent.

The stripping with hydrogen gas at an elevated temperature, in addition to effecting additional removal of volatile components from the effluent, which increases hydrogen partial pressure, results in the further advantage that hydrogen dissolves in the hot liquid effluent thereby providing partial recycle of hydrogen gas without a recycle compressor. In addition, such recycle directionally improves the hydrogen partial pressure in reactor 11.

A stripped or lean hydrotreated effluent is withdrawn from column 19 through line 31 and a portion thereof recovered through line 32, as net product. The remaining portion in line 33 is cooled in exchanger 34, as required, and employed as recycle in line 14. As hereinabove noted, the use of a lean recycle; i.e., lean with respect to more volatile components, results in higher hydrogen partial pressures in reactor 11, at a given total pressure.

The stripping gas, contained stripped and flashed volatile components, is withdrawn from column 19 through line 41, combined with separated liquid in line 42 from separator 23, passed through condenser 43, and introduced into flash drum 44 to separate vapor and liquid. The flash drum 44 preferably operates at the pressure of stripping column 19.

This vapor is rich in hydrogen and as such can be reused as make up hydrogen to other hydrogenation reactions or it can be recycled to the olefins plant of origin for hydrogen and hydrogen recovery. Vapor is removed from drum 44 through line 45. Liquid is withdrawn from drum 44 through line 46 and forms a part of the net hydrotreated product.

The hereinabove described embodiment may be modified within the spirit and scope of the invention. Thus, for example, separation of volatile components can be effected other than as particularly described provided that there is provided a leaned recycle which results in increased hydrogen partial pressure. Similarly, it is possible to subject only the recycle portion of the effluent to the operation for separating the more volatile components, rather than the entire effluent as described.

Still another modification involves separation of the volatile components from the effluent, without stripping with hydrogen gas, as hereinafter described with reference to FIG. 2.

Referring to FIG. 2, as described with reference to the embodiment of FIG. 1, pyrolysis gasoline in line 113, leaned recycle effluent in line 114 and hydrogen containing gas in line 110 are introduced into hydrotreating reactor 111 including a hydrotreating catalyst bed 112, to selectively hydrotreat di-olefins and styrene.

A hydrotreated liquid effluent is withdrawn from reactor 111 through line 116 and introduced into flashing column 201 operated at a temperature and pressure to flash the more volatile components from the liquid effluent. In column 201, separation of volatile components is effected by flashing, without additional stripping by the use of hydrogen containing gas, as described with reference to FIG. 1. In general, column 201 is operated at a pressure of from 50 to 200 psi lower than the reaction pressure, as described with reference to embodiment of FIG. 1. As should be apparent, a lower amount of less volatile components is separated from the effluent than is separated by proceeding in accordance with the embodiment of FIG. 1, which includes flashing and stripping, whereby the hydrogen partial pressures achieved in reactor 111 are less than those achieved in reactor 11 of FIG. 1; however, the hydrogen partial pressures are greater than those achieved by the use of conventional procedures.

The leaned liquid effluent is withdrawn from column 201 through line 202, with a first portion being recovered as net product in line 203, and a second portion being recycled to the hydrotreating reactor through line 133 including cooler 134.

A vapor effluent is withdrawn from reactor 111 through line 204, and combined with flashed vapors from column 201 in line 206, for passage through condenser 143 for introduction into flash drum 144, which preferably operates at the pressure of column 201.

Vapor is withdrawn from drum 144 through line 145. Liquid is withdrawn from drum 144 through line 146, and forms part of the net product.

The present invention will be further illustrated with respect to the following example; however, the scope of the invention is not to be limited thereby.

EXAMPLE

The following are illustrative conditions for the hydrotreating of pyrolysis gasoline in accordance with the embodiment of FIG. 1:

| Line | 10 | 13 | 14 | 15 | 16 | 21 | 24 | 41 |
|---|---|---|---|---|---|---|---|---|
| Temp° F | 100° | 100° | 380° | 335° | 400° | 400° | 100° | 395° |
| Pressure, psia | 400 | 450 | 450 | 400 | 410 | 400 | 260 | 250 |
| Flow rate moles/hr | 58 | 115 | 420 | 535 | 519 | 40 | 186 | 92 |
| Mol % of $C_5$ and lighter | — | 23 | 8.0 | 11.2 | 13.0 | — | — | — |
| Mol % of $H_2$ | 95 | — | — | — | — | 42.8 | 90 | 23.0 |

The present invention is particularly advantageous in that the hydrogen partial pressure in the pyrolysis gasoline hydrotreating reactor can be increased, thereby permitting the use of lower total reaction pressures, while simultaneously deriving the improved kinetics resulting from such higher hydrogen partial pressure. The ability to use lower total pressures eliminates the necessity for booster compressor for the hydrogen containing gas. Thus, by proceeding in accordance with the invention it is possible to operate the hydrotreating reactor at the delivery pressure of the available hydrogen containing gas at hydrogen partial pressures which are greater than those which can be achieved by proceeding in accordance with conventional procedures.

Numerous modifications and variations of the present invention are possible in light of the above teachings and, therefore, within the scope of the appended claims, the invention may be practiced otherwise than as particularly described.

What is claimed is:

1. In a process for hydrotreating pyrolysis gasoline wherein fresh feed pyrolysis gasoline, hydrogen-containing gas and recycle hydrotreated effluent are contacted in a hydrotreating zone, a hydrotreated effluent is withdrawn from the hydrotreating zone and a portion of the hydrotreated effluent is recycled to the hydrotreating zone, the improvement comprising:

operating said hydrotreating zone at a total pressure of from 200 to 400 psig and a log mean hydrogen partial pressure of from 135 to 260 psig; and separating from at least said portion of the hydrotreated effluent recycled to the hydrotreating zone, at least 5 mole percent of $C_5$ and lighter hydrocarbons to provide in said hydrotreating zone said log mean hydrogen partial pressure at said total pressure.

2. The process of claim 1 wherein hydrogen-containing gas is introduced into the hydrotreating zone in an amount of from 10 to 50% over that required to saturate one double bond of conjugated diolefins and styrenes in said feed.

3. The process of claim 2 wherein said $C_5$ and lighter hydrocarbons are separated by flashing at least said recycle hydrotreated effluent.

4. The process of claim 2 wherein said $C_5$ and lighter hydrocarbons are separated by both flashing and stripping with hydrogen-containing gas recovered from the hydrotreating zone.

5. The process of claim 2 wherein the flashing is effected at a pressure of from 50 to 200 psi less than said total pressure in the hydrotreating zone.

6. The process of claim 2 wherein at least 20 mol % of said $C_5$ and lighter hydrocarbons are separated from at least said recycle hydrotreated effluent.

7. The process of claim 5 wherein the hydrotreating zone is operated at said total pressure corresponding to the delivery pressure of the hydrogen-containing gas.

* * * * *

UNITED STATES PATENT OFFICE

CERTIFICATE OF CORRECTION

Patent No. 4,097,370 Dated June 27, 1978

Inventor(s) Ari A. Minkkinen

It is certified that error appears in the above-identified patent and that said Letters Patent are hereby corrected as shown below:

Column 2, Line 34, insert -- reactor -- after "total";

Column 4, Line 14, "contained" should be -- containing -- ;

Column 3, Line 1, "conmbination" should be -- combination -- ;

Column 6, Line 30, "2" should be -- 3 -- ;

Column 6, Line 34, "2" should be -- 3 -- ;

Column 6, Line 40, "5" should be -- 6 -- .

Signed and Sealed this

*Twenty-fourth* Day of *April 1979*

[SEAL]

*Attest:*

RUTH C. MASON
*Attesting Officer*

DONALD W. BANNER
*Commissioner of Patents and Trademarks*